United States Patent [19]

Herman et al.

[11] Patent Number: 4,777,852

[45] Date of Patent: Oct. 18, 1988

[54] RATCHETING SCREWDRIVER

[75] Inventors: Timm R. Herman, Kenosha; Donald J. Caldwell, Milwaukee; Allan J. Bliemeister, Kenosha; Eric T. Gustafson, Racine; Mark S. Bakula, Muskego, all of Wis.

[73] Assignee: Snap-on Tools Corporation, Kenosha, Wis.

[21] Appl. No.: 914,739

[22] Filed: Oct. 2, 1986

[51] Int. Cl.[4] ..... B25B 16/46

[52] U.S. Cl. ..... 81/63.1

[58] Field of Search ..... 81/62, 63.1, 177.4, 81/490; 192/43.2

[56] References Cited

U.S. PATENT DOCUMENTS

| | | | |
|---|---|---|---|
| 277,561 | 5/1883 | Furbish . | |
| 371,225 | 10/1887 | Stevens . | |
| 569,955 | 10/1896 | Chesney . | |
| 791,895 | 6/1905 | Furbish . | |
| 878,657 | 2/1908 | Munch | 81/63.1 X |
| 880,870 | 3/1908 | Ellrich . | |
| 1,388,836 | 8/1921 | Ripsch et al. | 192/43.2 X |
| 2,564,356 | 8/1951 | Dianda . | |
| 3,061,061 | 10/1962 | Browning . | |
| 3,356,117 | 12/1967 | Wagner . | |
| 3,742,787 | 7/1973 | Whiteford . | |
| 3,844,831 | 10/1974 | Cass et al. . | |
| 4,086,831 | 5/1978 | Smith . | |
| 4,280,379 | 7/1981 | Chow | 81/62 |
| 4,290,328 | 9/1981 | Clark . | |
| 4,427,100 | 1/1984 | Rude et al. . | |
| 4,466,460 | 8/1984 | Orcutt . | |
| 4,488,460 | 12/1984 | Ballone et al. . | |
| 4,529,071 | 7/1985 | Gagnon et al. . | |
| 4,621,718 | 11/1986 | DeCarolis | 81/63.1 X |

*Primary Examiner*—Frederick R. Schmidt
*Assistant Examiner*—Bradley I. Vaught
*Attorney, Agent, or Firm*—Emrich & Dithmar

[57] ABSTRACT

The ratcheting screwdriver comprises a handle having a bore and a keyway substantially tangent thereto. In the bore is a gear and in the keyway are a pair of pawls which are movable individually into and out of engagement with the gear. An actuator is provided at the forward end of the handle to move these pawls. A cap operates the actuator.

21 Claims, 2 Drawing Sheets

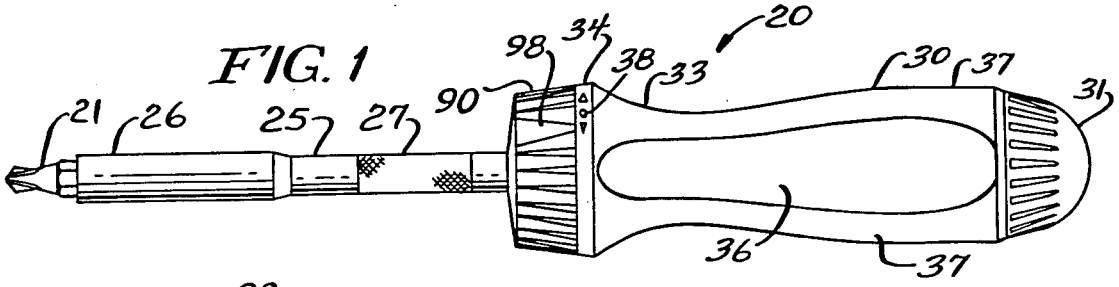
FIG. 1
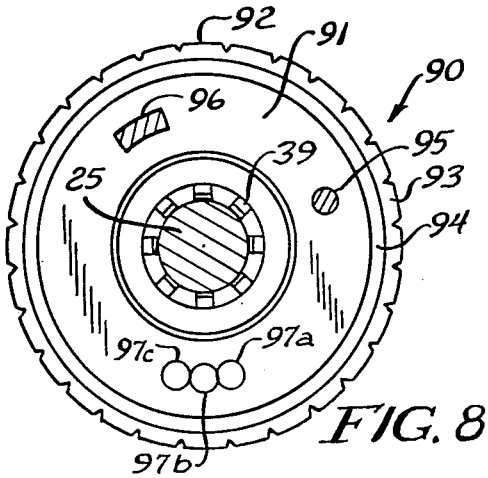
FIG. 8
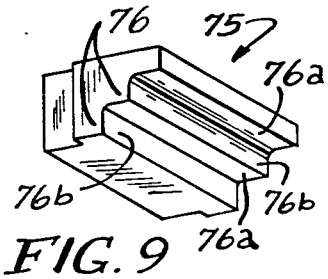
FIG. 9
FIG. 7
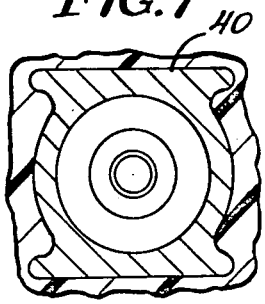
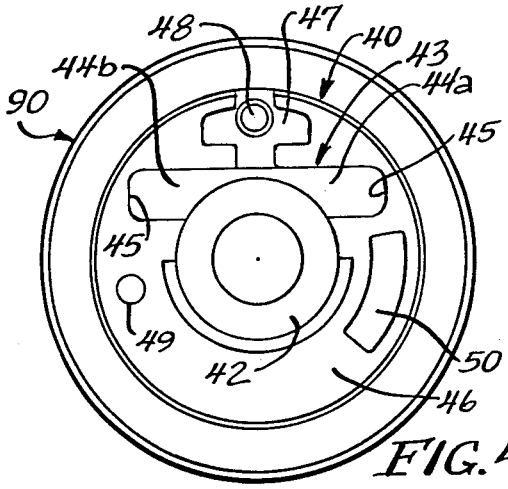
FIG. 4
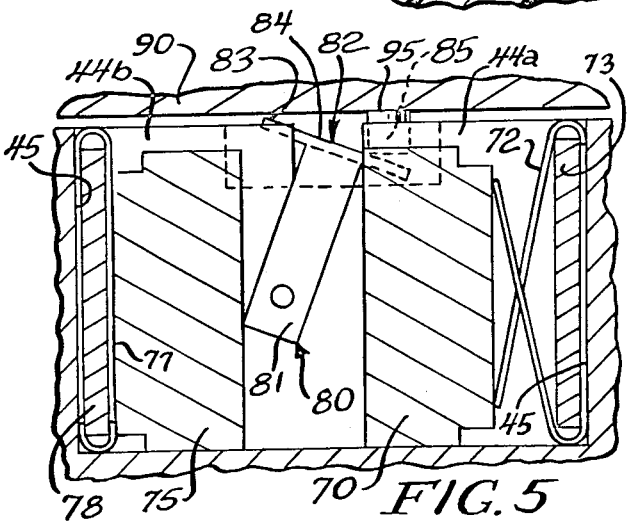
FIG. 5
FIG. 12
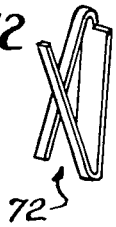
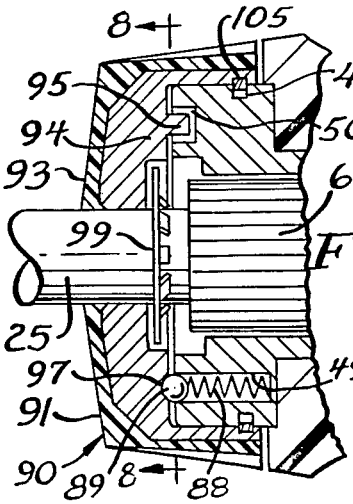
FIG. 6
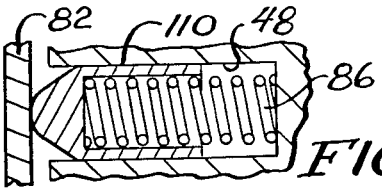
FIG. 10
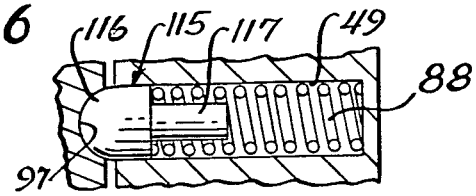
FIG. 11
FIG. 13
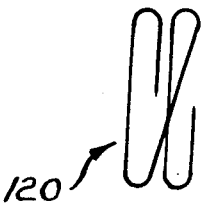

RATCHETING SCREWDRIVER

BACKGROUND OF THE INVENTION

This invention relates to a ratcheting driver used for driving screws, nuts and the like. Such drivers in the past have had weak mechanisms which tend to break during use. Also, they have not been capable of delivering as much torque as desired.

SUMMARY OF THE INVENTION

It is therefore an important object of the present invention to provide a ratcheting driver which is rugged, stronger and less subject to damage during use.

Another object is to provide a ratcheting driver which is capable of delivering higher torque than that provided by currently available drivers.

Another object is to provide a ratcheting driver in which the means to change the direction of ratcheting or change to a non-ratcheting driver is readily accessible to the user without having to search for it.

Another object is to provide a ratcheting driver in which the handle need be rotated only a few degrees to obtain a new "bite".

Another object is to provide a ratcheting driver which is elongated and slim, like a standard screwdriver.

In summary, there is provided a ratcheting driver comprising a handle, means defining a bore and a keyway therein, the bore being generally cylindrical, a tubular gear in the bore having an external set of teeth, the keyway being generally tangent to the bore and communicating therewith, first and second pawls in the keyway generally on opposite sides of the gear, and means for selectively moving the pawls into and out of engagement with the gear, the handle rotating the gear in one direction and ratcheting with respect to the gear in the opposite direction when the first pawl is in engagement with the gear, the handle rotating the gear in the opposite direction and ratcheting with respect to the gear in the one direction when the second pawl is in engagement with the gear, the handle rotating the gear in both directions and ratcheting the gear in neither direction when both of the pawls are in engagement with the gear.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is an elevation view of the ratcheting driver incorporating the features of the present invention;

FIG. 4 is a view like FIG. 3, but on a smaller scale and with the gear, pawls, actuator and the like removed;

FIG. 5 is an enlarged view taken in section along the line 5—5 of FIG. 3;

FIG. 6 is a view in section taken along the line 6—6 of FIG. 3, on a slightly smaller scale;

FIG. 7 is a view in section taken along the line 7—7 of FIG. 2;

FIG. 8 is a view of the control cap taken along the line 8—8 of FIG. 6;

FIG. 9 is a perspective view of one of the pawls;

FIG. 10 is an enlarged view of an alternative biasing means for the actuator;

FIG. 11 depicts an alternative detent mechanism;

FIG. 12 depicts one of the springs that biases a pawl; and

FIG. 13 depicts an alternative spring to bias the pawls.

DESCRIPTION OF THE PREFERRED EMBODIMENT

Figure 2:
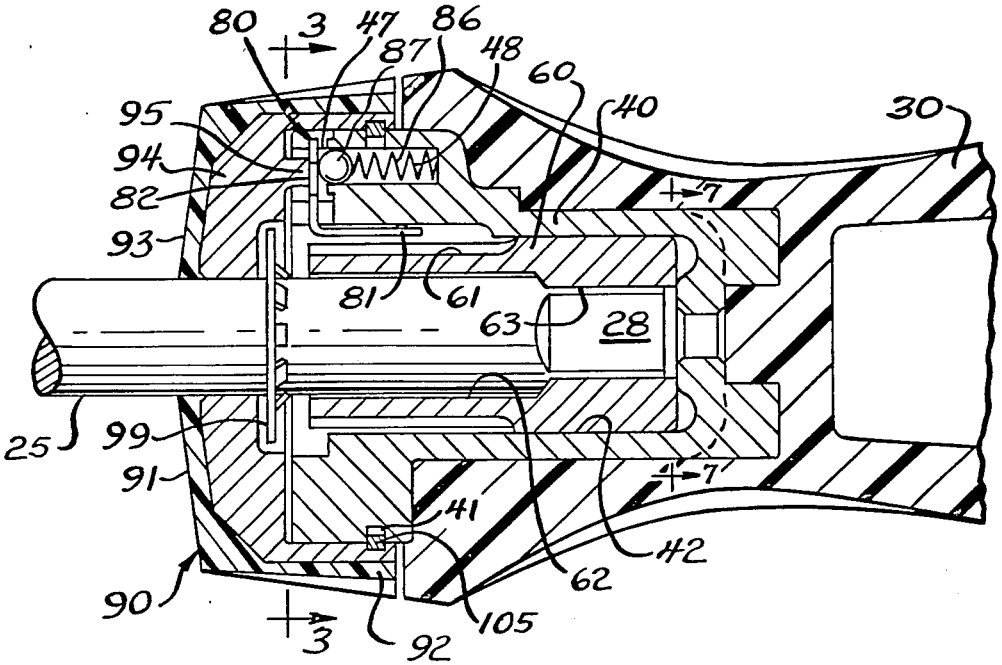
FIG. 2 is a fragmentary view in longitudinal section, on an enlarged scale, through the central portion of the driver of FIG. 1.

Turning now to the drawings and more particularly to FIG. 1 thereof, there is depicted a ratcheting screwdriver 20 incorporating the features of the present invention. The screwdriver 20 carries a removable bit 21 for use in driving a Phillips screw. Various designs of bits well known in the industry may be substituted for the bit shown. The screwdriver 20 includes a shank 25 having an enlarged end defining a receptacle 26 for the bit 21. Within the receptacle 26 is a magnet (not shown) to which the bit 21 is attracted and thereby removably held. The shank 25 has a portion with a knurled surface 27 to facilitate gripping by the user.

The shank 25 is mounted in an elongated handle 30. At one end of the handle 30 is a cover 31 which may be unscrewed to expose a compartment (not shown) in which the bits are stored. The other end of the handle 30 tapers into a neck 33 and then flares to form a head 34. The handle 30 has four slightly concave surfaces 36 separated by four convex surfaces 37, which design facilitates holding of the handle 30 and gripping it tightly. On the head 34 are indicia 38 consisting of a pair of oppositely directed arrows and a dot between the arrows. Each arrow signifies that the screwdriver 20 is rotated in that direction and is ratcheted in the opposite direction. The center dot signifies the position in which the screwdriver 20 functions without any ratcheting.

Referring to FIG. 2, a metal insert 40 is mounted in the front of the handle 30 particularly in the region of the head 34 and the neck 33. The handle 30 is preferably constructed of high impact plastic and the insert 40 is molded in place. As can be seen in FIG. 7, the sides of the insert 40 define flange-like elements to enable secure retention in the plastic handle. The insert 40 has an enlarged forward end about which a groove 41 (FIG. 2) is provided, used for locking purposes as will be described. Referring to FIG. 4, the insert 40 has a centrally located bore 42 which is generally cylindrical in shape and the axis of which is collinear with the longitudinal axis of the handle 30. The insert 40 also has a keyway 43 which communicates with the bore 42 and is generally tangent thereto. The keyway 43 has portion **44*a* on one side of the bore 42 and a portion 44*b* on the other side of such bore. The ends of the keyway 43 are defined by two surfaces 45** which face each other and are generally parallel to each other and to the axis of the bore 42. The insert 40 has an annular, forwardly facing surface 46 generally perpendicular to the axis of the bore 42. A generally cruciform recess 47 is in the surface 46. In the bottom surface of the recess 47 is an axially extending hole 48. An axially extending hole 49 is in the surface 46 but spaced from the hole 48 about 100°. An arcuate slot 50 in the surface 46 extends approximately from 90° to 135° removed from the hole 48.

Figure 3:
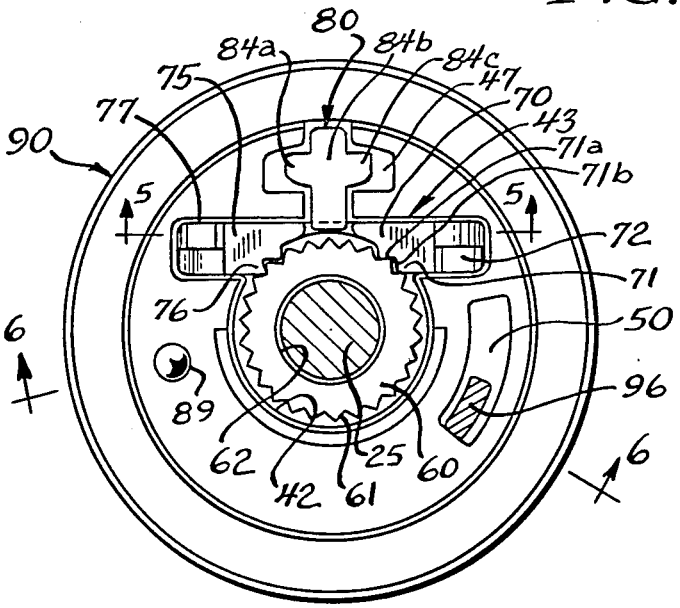
FIG. 3 is a view in vertical section taken along the line 3—3 of FIG. 2.

Turning to FIGS. 2 and 3, the screwdriver 20 further comprises a tubular gear 60 which is generally cylindrical and is located in the bore 42 and is freely rotatable therein. The forward half of the gear 60 has a multiplicity of teeth 61. In the embodiment depicted the gear has 26 teeth. Extending axially through the tubular gear 60 is an opening 62, the forward portion of which is cylindrical and the rear end 63 of which is square. The shank 25 extends into the opening 62 and the square end 28 mates with the square end 63 of the opening 62. Accordingly, the shank 25 is fixed to the tubular gear 60 so as to rotate therewith.

The screwdriver 20 further comprises a pawl 70 which has the shape generally of a parallelepiped, except that one edge is replaced with axially extending teeth 71, which teeth have a shape to mesh with the teeth 61 on the tubular gear 60. Each tooth 71 is defined by a locking surface 71*a* and a camming surface 71*b*. The corresponding surfaces of a second pawl 75 are more clearly shown in FIG. 9. Referring back to the pawl 70, the locking surface 71*a* of each tooth is located generally parallel to the direction of elongation of the keyway 43, while each camming surface 71*b* is generally perpendicular to such direction of elongation.

The pawl 70 is located in the keyway portion 44*a* (FIG. 4). A spring 72 (see FIG. 12 also) is located between the pawl 70 and the adjacent one of the walls 45. An axially extending strip 73 (FIG. 5) is disposed in the spring 72 to prevent crimping of the ends of the spring as it is compressed. The spring 72 biases the pawl 70 to the left, as viewed in FIG. 3, against the tubular gear 60.

The screwdriver 20 further comprises a second pawl 75 which has a construction identical to the pawl 70. Its teeth 76 are designed also to mesh with the teeth 61 of the tubular gear 60. A spring 77, identical to the spring 72, is disposed between the pawl 75 and the left hand one of the surfaces 45. An axially extending strip 78 (FIG. 5) in the spring 77 serves the same purpose as the strip 73. As a result, the pawl 75 is biased to the right, as viewed in FIG. 3, against the tubular gear 60.

It may be seen that when the pawls 70 and 75 are in the positions depicted in FIG. 3, against the gear 60, the handle 30 cannot rotate with respect to the shank 25, because the locking surfaces 71*a* engage the gear 60 when the handle is rotated counterclockwise (clockwise in FIG. 3) and the locking surfaces 76*a* engage the gear 60 when the handle is rotated clockwise. When the handle 30 is rotated in one direction, the shank 25 and the bit 21 carried thereby rotate in the same direction. When the handle is rotated in the other direction, the shank 25 will rotate in the opposite direction. In other words, when both pawls 70 and 75 are against the gear 60, the screwdriver 20 acts as a standard, non-ratcheting screwdriver.

The pawls 70 and 75 are movable within the keyway 43. More specifically, the pawl 70 may be moved, against the biasing of the spring 72, to a position closer to the right hand wall 45 in which event the pawl 70 is disengaged from the gear 60. The pawl 75 continues to engage the gear 60. When one rotates the handle 30 clockwise (counterclockwise in FIG. 3), the locking surfaces 76*a* engage the gear 60 so that the shank 25 rotates with the handle to tighten the fastener. When the handle 30 is rotated counterclockwise (clockwise in FIG. 3) the camming surfaces 76*b* engage the teeth 61 and cause the pawl 75 to move to the left. Thus, the handle 30 ratchets when it is rotated counterclockwise.

If the pawl 75 is moved toward the left and the pawl 70 is allowed to return to its rest position, the pawl 75 is disengaged. When one rotates the handle 30 counterclockwise (clockwise in FIG. 3), the locking surfaces 71*a* engage the gear 60 so that the shank 25 rotates with the handle to loosen the fastener. When the handle 30 is rotated clockwise (counterclockwise in FIG. 3) the camming surfaces 71*b* engage the teeth 61 to move the pawl 70 out of the way. Thus the handle ratchets when it is rotated clockwise.

Referring to FIGS. 2 and 3, in order to move the pawls 70 and 75 between their locked and unlocked positions, there is provided an actuator 80. The actuator 80 is generally L shaped, having a lever 81 and an engagement portion 82. The lever 81 extends rearwardly into the keyway 43 between the pawls 70 and 75. The engagement portion 82 is generally cruciform so as to define a radially directed leg and a laterally directed leg. The radially directed leg divides the laterally directed leg into three areas 84*a*, 84*b* and 84*c*. A spring 86 is located in the hole 48, which biases a ball 87 forwardly and against the engagement portion 82 and specifically against the area 84*b*. A spring 88 is located in the hole 49, which biases a ball 89 forwardly (FIG. 6).

Referring to FIGS. 2 and 8, the screwdriver 20 further comprises a control cap 90 having a forwardly disposed wall 91 and a circumferentially extending skirt 92. The cap 90 is defined by an inner core 94 molded in place in a plastic skin 93. Depending from the wall 91, that is extending rearwardly therefrom, is a pin 95 which contacts the engagement portion 82 of the actuator 80 and is movable between the three areas thereof, as will be explained. Also depending from the wall 91, that is, extending rearwardly therefrom, is a stud 96 which resides in the recess 50 (FIG. 3). The radially extending ends of the slot 50 limit the extent of rotation of the cap 90 as will be explained. The wall 91 has a set of three semi-circular recesses or detents 97*a*, 97*b* and 97*c*, sized to receive the ball 89 (FIG. 6). The skirt 92 bears a pointer 98 (FIG. 1) that points to the indicia 38. A lock ring 99 limits the extent of rearward movement of the cap 90.

A retaining ring 105 simultaneously resides in the groove 41 of the insert 40 and a mating groove in the skirt 91, so as to attach the cap 90 to the handle 30, yet to permit the cap to be rotatable thereon. The retaining ring 105 is annular having its ends slightly spaced apart so that they can be drawn toward one another to move the ring to a position entirely within the groove 41 to permit the cap 90 to be removed. To install the cap in place, the reverse procedure is effected. The ends of the retaining ring 105 are accessible through a slot (not shown) in the skirt 92 of the cap 90.

In operation, when the cap 90 is rotated to a position such that the pointer 98 is aligned with the dot of the indicia 38, the ball 89 will be located in the middle detent 97*b*. The pin 95 will be disposed against the area 84*b* of the engagement portion 82. As a result, the plane of the engagement portion 82 will be perpendicular to the handle axis. The axis of the lever 81 will be parallel to the longitudinal axis and will be thus between the pawls 70 and 75, not engaging either. Both pawls 70 and 75 continue to engage the gear 60 as the result of the biasing furnished by the springs 72 and 77. The shank 25 is thus fixed to the handle 30 so that, in whichever direction the handle 30 is rotated, the shank 25 will rotate therewith. The screwdriver 20 therefore acts like a non-ratcheting driver.

When the cap 90 is rotated so that the pointer 98 is aligned with the lower (as viewed in FIG. 1) arrow of the indicia 38 the ball 89 is forced toward the rear and out of the detent **97*b* and snaps into the detent 97*c*. The pin 95 will be moved into alignment with the engagement area 84*c*, thereby to tilt the engagement portion 82 and cause the lever 81 to assume the solid line position depicted in FIG. 5. The stud 96 engages the clockwise-most end of the slot 50 to limit the extent of rotation of the cap 90. The lever 81 pushes the pawl 75 toward the left, as viewed in FIG. 5, against the action of the spring 77 to disengage the pawl 75 from the gear 60. As explained previously, when the pawl 70 is engaged, the handle 30 ratchets clockwise with respect to the shank 25**, but is engaged with the shank in the counterclockwise direction. In this condition, the screwdriver may be used to rotate screws counterclockwise to loosen them, while ratcheting in the clockwise direction.

If the control cap 90 is rotated such that the pointer 98 is aligned with the upper arrow in FIG. 1, the ball 89 will snap into the detent **97*a*. The pin 95 will engage the area 84*a* of the engagement portion 82 to tilt the lever 80 at a plus angle with respect to the axis of the screwdriver and move the pawl 70, against the action of the spring 72, out of engagement with the gear 60. The pawl 75 continues to be urged into engagement with the gear 60 by the spring 77. In this condition, the handle 30 is locked to the shank 25** when the handle is rotated clockwise to enable tightening of screws, and is ratcheted in the counterclockwise direction.

A modification is depicted in FIG. 10. In the hole 48 is the same spring 86, but instead of the ball 87, a bayonet 110 is provided. Bayonet 110 is hollow so as to receive the forward end of the spring 86. The end of the bayonet 110 engages the area **84*b* of the engagement portion 82, generally in the manner of the ball 87. Another modification is depicted in FIG. 11. In the hole 49 is located the spring 88, but in place of the ball 89 is a post 115 having a head 116 and a reduced diameter shaft 117 residing in the spring 88. The outer end of the head 116 is hemispherical and resides in the selected one of the detents 97*a–c*. The post 115 can also replace the ball 87** if desired.

FIG. 13 depicts an alternative to the springs 72 and 77. The spring 120 is formed of a wire bent as indicated.

It may be seen that the screwdriver 20 is readily changed from non-ratcheting to ratcheting in either direction by simply rotating the cap 90 at the base of the handle 30. Bits 21 are removed from the storage compartment in the handle and inserted and held in place magnetically in the receptacle 26. The configuration of the pawls 70 and 75 and the gear 60 enable substantial surface contact between these parts so as to provide the screwdriver 20 with substantial strength and the capability of exerting high torque. The large number of teeth 61 on the gear 60 enable fine ratcheting. With 26 teeth, one need turn the driver 20 only a few degrees (about 14°) to get a new "bite". The elongated configuration of each of the pawls 70 and 75 provide for a substantial surface contact with the teeth 61 to enhance the strength and ability to exert torque. The actuator being the control cap 90 provides a 360° surface defined by the skirt 92 which the user can engage with his thumb (or other finger) to change the ratcheting direction. In other words he need not grope looking for the actuator. He knows it is at the base of the handle and can be grasped by the thumb irrespective of the orientation of the driver in his hand.

While a screwdriver has been described, it is to be understood that the ratcheting mechanism can be used in any kind of driver such as one that can tighten and loosen nuts and bolts.

While there have been described what are considered to be the preferred embodiments, it is to be understood that various modifications can be made without departing from the spirit or scope of the invention as defined in the claims appended hereto.

We claim:

1. A ratcheting screwdriver comprising an elongated handle having an axis, means defining a bore and a keyway extending axially in said handle, said bore being generally cylindrical, a tubular gear in said bore having an external set of teeth and having an axis, the axis of said handle and the axis of said gear being substantially collinear, said keyway being generally tangent to said bore and communicating therewith, first and second pawls each having multiple teeth and residing in said keyway generally on opposite sides of said gear, said keyway channeling movement of said pawls and restricting pawl movement to directions parallel to the tangent, and actuator means for selectively moving said pawls into and out of engagement with said gear, said actuator means protruding laterally outwardly no farther than said handle, said acutator means including lever means engageable with said pawls, and control means manually movable among three positions in sliding engagement with said lever means for controlling the operation thereof, said handle rotating said gear in one direction and ratcheting with respect to said gear in the opposite direction when said first pawl is in engagement with said gear, said handle rotating said gear in said opposite direction and ratcheting with respect to said gear in said one direction when said second pawl is in engagement with said gear, said handle rotating said gear in both directions and ratcheting said gear in neither direction when both of said pawls are in engagement with said gear.

2. The ratcheting screwdriver of claim 1, wherein said bore and said keyway area located at one end of said handle, and further comprising a cover removably closing a storage compartment located in the other end of said handle.

3. The ratcheting screwdriver in claim 1, wherein said bore and keyway defining means is a metal insert mounted in said handle.

4. The ratcheting screwdriver of claim 1, wherein said handle is elongated, said bore and keyway defining means being an insert in one end of said handle.

5. The ratcheting screwdriver of claim 1, wherein said gear has an axially extending opening therein, and further comprising a shank being disposed in said opening and being constructed and arranged to rotate with said gear.

6. The ratcheting screwdriver of claim 5, wherein said shank has a polygonal portion and said axially extending opening has a polygonal portion, said polygonal portions mating together so that said shank rotates with said gear.

7. The ratcheting screwdriver of claim 1, wherein said gear has on the order of about 26 teeth thereon.

8. The ratcheting screwdriver of claim 1, wherein each of said pawls is elongated in the direction of said bore.

9. The ratcheting screwdriver of claim 1, wherein each of said pawls is generally in the form of a parallelepiped having teeth along one edge thereof in the direction of the axis of said bore so as to provide substantial surface contact with said gear.

10. The ratcheting screwdriver of claim 1, wherein said keyway is defined by a pair of surfaces parallel to each other and to the axis of said bore, said biasing means including a first spring between said first pawl and one of said surfaces and a second spring between said second pawl and the other of said surfaces.

11. A ratcheting screwdriver comprising an elongated handle having an axis, means defining a bore and a keyway extending axially in said handle, said bore being generally cylindrical, a tubular gear in said bore having an external set of teeth and having an axis, the axis of said handle and the axis of said gear being substantially collinear said keyway being generally tangent to said bore and communicating therewith, first and second pawls each having multiple teeth and residing in said keyway generally on opposite sides of said gear, said keyway channeling movement of said pawls and restricting pawl movement to directions parallel to the tangent, means for biasing said pawls into engagement with said teeth on said gear, said handle rotating said gear in one direction and ratcheting with respect to said gear in the opposite direction when said first pawl is in engagement with said gear, said handle rotating said gear in said opposite direction and ratcheting with respect to said gear in said one direction when said second pawl is in engagement with said gear, said handle rotating said gear in both directions and ratcheting said gear in neither direction when both of said pawls are in engagement with said gear, actuator means for selectively moving said pawls against said biasing means into and out of engagement with said gear, said actuator means protruding laterally outwardly no farther than said handle, said actuator means including a lever extending into the space between said pawls, said lever being movable between a first position at a plus angle with respect to the axis of said bore, and a second position at a minus angle with respect to said axis, and a third position parallel to said axis, said lever in the first position thereof moving said first pawl away from said gear, said lever in the second position thereof moving said second pawl away from said gear, said lever in the third position thereof having no effect on the positions of said pawls.

12. The ratcheting screwdriver of claim 11, wherein said actuator means includes an engagement portion having first and second and third areas thereon respectively corresponding to the three positions of said lever, and further comprising a control member for selectively engaging said areas respectively to move said lever to the three positions thereof.

13. The ratcheting screwdriver of claim 11, wherein said bore and keyway defining means includes an opening therein having an axis generally parallel to the axis of said bore and being aligned with said engagement portion, biasing means in said opening to bias said engagement portion toward said control member.

14. A ratcheting screwdriver comprising a handle, means defining a bore and a keyway therein, said bore being generally cylindrical, a tubular gear in said bore having an axially extending opening therein and an external set of teeth, said keyway being generally tangent to said bore and communicating therewith, first and second pawls in said keyway generally on opposite sides of said gear, a shank in said opening and constructed and arranged to rotate with said gear, means for biasing said pawls into engagement with the teeth on said gear, said handle rotating said gear in one direction and ratcheting with respect to said gear in the opposite direction when said first pawl is in engagement with said gear, said handle rotating said gear in said opposite direction and ratcheting with respect to said gear in said one direction when said second pawl is in engagement with said gear, said handle rotating said gear in both directions and ratcheting said gear in neither direction when both of said pawls are in engagement with said gear, actuator means for selectively moving said pawls against said biasing means into and out of engagement with the teeth on said gear, said actuator means including a lever extending into the space between said pawls, said lever being movable between a first position at a plus angle with respect to the axis of said bore and a second position at a minus angle with respect to said axis and a third position parallel to said axis, said lever in the first position thereof moving said first pawl away from said gear, said lever in the second position thereof moving said second pawl away from said gear, said lever in the third position thereof having no effect on the positions of said pawls, said actuator means including an engagement portion having first and second and third areas thereon respectively corresponding to the three positions of said lever, and a control cap having a hole through which said shank extends, said control cap having a depending pin which engages said engagement portion, said control cap being rotatable between first and second and third positions, said pin engaging said first area to cause said lever to be in the first position thereof when said control cap is in its first position, said pin engaging said second area to cause said lever to be in the second position thereof when said control cap is in its second position, said pin engaging said third area to cause said lever to be in the third position thereof when said control cap is in its third position.

15. The ratcheting screwdriver of claim 14, wherein said control cap is cup-shaped having a forward wall and a skirt.

16. The ratcheting screwdriver of claim 14, wherein said handle is elongated and said bore and said keyway therein are parallel to the axis of said handle, said control cap being located at one end of said handle.

17. The ratcheting screwdriver of claim 14, where said control cap has a depending stud, said bore and keyway defining means having an arcuate slot which receives said stud, said stud being movable in said slot to limit the extent of rotation of said control cap.

18. The ratcheting screwdriver of claim 14, wherein said control cap has three spaced-apart detents respectively corresponding to the three positions thereof, said bore and keyway defining means carrying outwardly biased means seated in one of said three detents depending upon the position of said control cap.

19. The ratcheting screwdriver of claim 14, and further comprising coupling means for preventing axial movement of said control cap with respect to said handle and permitting only rotational movement thereof.

20. The ratcheting screwdriver of claim 19, wherein said coupling means includes a groove in said handle and a groove in the skirt of said control cap and an annular retaining ring in both of said grooves.

21. The ratcheting screwdriver of claim 14, wherein the control cap has a surface extending 360° so as to be readily accessible by a person's finger irrespective of the orientation of the driver in the person's hand.

* * * * *